US007966987B2

(12) United States Patent
Sato et al.

(10) Patent No.: US 7,966,987 B2
(45) Date of Patent: Jun. 28, 2011

(54) AIR-COOLED ENGINE

(75) Inventors: Yoshikazu Sato, Wako (JP); Souhei Honda, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 586 days.

(21) Appl. No.: 11/993,489

(22) PCT Filed: Jun. 16, 2006

(86) PCT No.: PCT/JP2006/312551

§ 371 (c)(1),
(2), (4) Date: Sep. 19, 2008

(87) PCT Pub. No.: WO2006/137499

PCT Pub. Date: Dec. 28, 2006

(65) Prior Publication Data

US 2009/0199793 A1 Aug. 13, 2009

(30) Foreign Application Priority Data

Jun. 23, 2005 (JP) ..... 2005-183094

(51) Int. Cl.
*F02B 75/22* (2006.01)
*F02F 3/00* (2006.01)

(52) U.S. Cl. ..... 123/195 R; 123/90.31; 123/193.5

(58) Field of Classification Search ..... 123/41.82 R, 123/193.1, 193.3, 193.5, 195 R, 90.31
See application file for complete search history.

(56) References Cited

U.S. PATENT DOCUMENTS 4,395,980 A 8/1983 Tominaga et al.
4,401,067 A 8/1983 Honda

FOREIGN PATENT DOCUMENTS

| | | | |
|---|---|---|---|
| DE | 27 03 520 | A | 8/1978 |
| DE | 36 21 478 | A | 1/1988 |
| EP | 1 403 496 | A1 | 3/2004 |
| FR | 1 197 813 | A | 12/1959 |
| JP | 2-32849 | Y2 | 9/1990 |
| JP | 3-189359 | A | 8/1991 |

OTHER PUBLICATIONS

Japanese Office Action dated Mar. 3, 2009, issued in corresponding Japanese Patent Application No. 2005-183094.
International Search Report of PCT/JP2006/312551, date of mailing Sep. 21, 2006.

*Primary Examiner* — Noah Kamen
(74) *Attorney, Agent, or Firm* — Westerman, Hattori, Daniels & Adrian, LLP

(57) ABSTRACT

There is provided an air-cooled engine (10) that is cooled by cooling air. The air-cooled engine (10) comprises a cylinder block (33), and a cylinder head (28) that closes off one end of a cylinder (26). The cylinder head (28) includes a base part (81) that is superposed on and secured to the cylinder block (33) by a plurality of bolts (91), and a valve compartment (83) formed integrally on the base part (81). All of the bolts (91) are disposed near the outer periphery of the base part (81) at positions outside of the valve compartment (83).

3 Claims, 12 Drawing Sheets

AIR-COOLED ENGINE

TECHNICAL FIELD

The present invention relates to an air-cooled engine wherein a cylinder head is fastened to a cylinder block with bolts.

BACKGROUND ART

In some air-cooled engines, the cylinder head is provided with a valve chamber for accommodating an intake valve and an exhaust valve, and the cylinder head is superposed on the cylinder block and is fastened on with bolts. This type of air-cooled engine is disclosed in Japanese Examined Utility Model Application No. 2-32849.

The air-cooled engine disclosed in Japanese Examined Utility Model Application No. 2-32849 is a multipurpose engine wherein a cylinder head provided with a valve chamber and a cooling air duct is superposed on and bolted to the cylinder block. The cylinder head includes three mounting holes disposed inside the valve chamber (valve compartment), and two mounting holes disposed outside the valve chamber. Bolts passed through these five mounting holes are screwed into the cylinder block, whereby the cylinder head can be attached to the cylinder block.

Lubricating oil is supplied to the interior of the valve chamber. Sufficient care must therefore be taken to prevent the lubricating oil from leaking through the mounting holes of the bolts inside the valve chamber. For example, oil leakage can be prevented by means of a gasket (seal member) having a complicated shape placed between the cylinder head and the cylinder block.

There is a large difference between the temperature of the bolts provided inside the valve chamber and the temperature of the bolts provided outside the valve chamber. Care must therefore be taken to maintain uniform thermal strain in the interior and exterior bolts. Furthermore, space is needed inside the valve chamber to allow the three bolts to be accommodated, and the valve chamber must be enlarged accordingly. Reducing the size of the air-cooled engine is therefore limited. It is apparent that the cylinder head constitutes part of the combustion chamber of the engine. The valve chamber is provided so as to cover part of the combustion chamber in the cylinder head. Therefore, with a large valve chamber, part of the combustion chamber is covered by the valve chamber, which impedes the cooling air in its ability to reach the vicinity of the combustion chamber.

In view of this, there is a need for techniques whereby oil leakage from the valve chamber can be prevented, the thermal strain in the bolts for securing the cylinder head can be made uniform, the engine can be reduced in size, and cooling air can be conducted to the vicinity of the combustion chamber.

DISCLOSURE OF THE INVENTION

The present invention provides an air-cooled engine that is cooled using cooling air, the engine comprising a cylinder block provided with a cylinder having a reciprocating piston, a crank case for accommodating and supporting a crank axle linked with the piston, and a cylinder head for closing off one end of the cylinder, wherein the cylinder head comprises a base part that is superposed on and secured to the cylinder block by a plurality of bolts, and a valve compartment formed integrally on the base part; the valve compartment accommodates an intake valve, an exhaust valve, and a camshaft for operating the intake valve and exhaust valve; and all of the bolts are disposed near the outer periphery of the base part at positions outside of the valve compartment.

Therefore, the lubricating oil supplied to the interior of the valve compartment, i.e., to the valve chamber, does not pass through the mounting holes for bolting the cylinder head onto the cylinder block, and the oil does not leak (for example, seep out) between the cylinder head and the cylinder block. Accordingly, there is no need to employ oil-sealing measures, such as placing a gasket (seal member) with a complicated shape between the cylinder head and the cylinder block, in order to prevent oil leakage from the valve chamber. The air-cooled engine can therefore have a simpler configuration.

Furthermore, since all of the bolts are disposed at positions outside of the valve compartment, the conditions under which the bolts are used (temperature and the like) can be kept substantially the same. The thermal strain in the bolts can be made uniform, and uniform and favorable thermal strain can therefore be maintained in the cylinder or the combustion chamber. Moreover, since the thermal strain in the bolts is uniform, the durability of the bolts can be sufficiently increased.

Since the bolts are disposed outside of the valve compartment, the bolts need not be placed-inside the valve chamber. The size of the valve compartment can be reduced inasmuch as no space need be provided to place the bolts inside the valve chamber, and the air-cooled engine can thereby be reduced in size.

Furthermore, a smaller valve compartment makes it possible to increase the surface area of the part of the cylinder head in which the area in the vicinity of the combustion chamber is exposed, i.e., the radiating surface area. Moreover, since the valve compartment is smaller, the distance from the outer surface of the valve compartment to the combustion chamber can be reduced. Cooling air can therefore be conducted to the vicinity of the combustion chamber. As a result, the area of the cylinder head that surrounds the combustion chamber can be cooled more adequately, and cooling efficiency can be improved.

The air-cooled engine preferably further comprises a power transmission mechanism for transmitting drive force from the crankshaft to the camshaft, and a transmission mechanism compartment for accommodating the power transmission mechanism, wherein at least part of the transmission mechanism compartment is formed in the cylinder head so as to be separated from the valve compartment. Adequate space can therefore be provided to allow cooling air to pass between the valve compartment and the transmission mechanism compartment. The effects of cooling the cylinder head are further improved by the passage of cooling air through this space.

Furthermore, it is preferable that the valve compartment and the transmission mechanism compartment be formed integrally by a coupler through which the camshaft passes, and that the coupler have a head-cooling duct formed therethrough to allow the cooling air to flow through. In this manner, a head-cooling duct can be formed in the cylinder head in the vicinity of the combustion chamber. The area of the cylinder head surrounding the combustion chamber can be more adequately cooled, and the cooling effects can be further improved by conducting cooling air into the head-cooling duct.

Furthermore, it is preferable that the cylinder block have cylinder-cooling ducts formed therethrough around the cylinder to allow the cooling air to flow through, and that the cylinder-cooling duct be linked with the head-cooling duct. Cooling air is therefore conducted through the head-cooling duct and the cylinder-cooling duct, whereby the cooling air is conducted to the vicinity of the combustion chamber in both the cylinder head and the cylinder block, and the cooling is made more efficient.

Furthermore, some of the bolts are preferably positioned between the valve compartment and the transmission mechanism compartment. Some of the bolts can therefore be disposed in the vicinity of the valve compartment in the same manner as the other bolts. As a result, the service temperature of the bolts can be made even more uniform. The thermal strain in all of the bolts can thereby be made more uniform.

BRIEF DESCRIPTION OF THE DRAWINGS

Certain preferred embodiments of the present invention will be described in detail below, by way of example only, with reference to the accompanying drawings, in which.

BEST MODE FOR CARRYING OUT THE INVENTION

Figure 1:
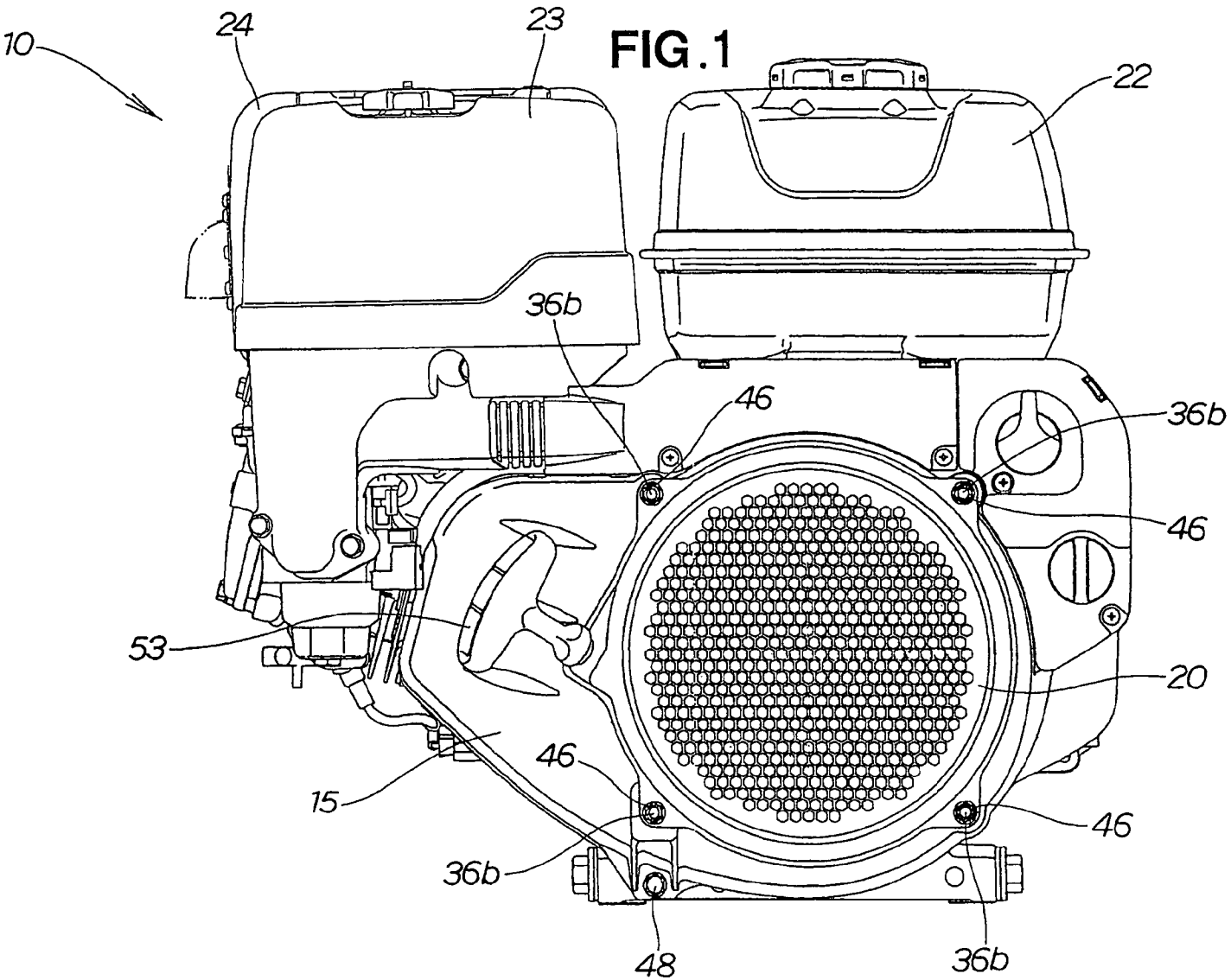
FIG. 1 is an external view of an air-cooled engine according to the present invention.
Figure 2:
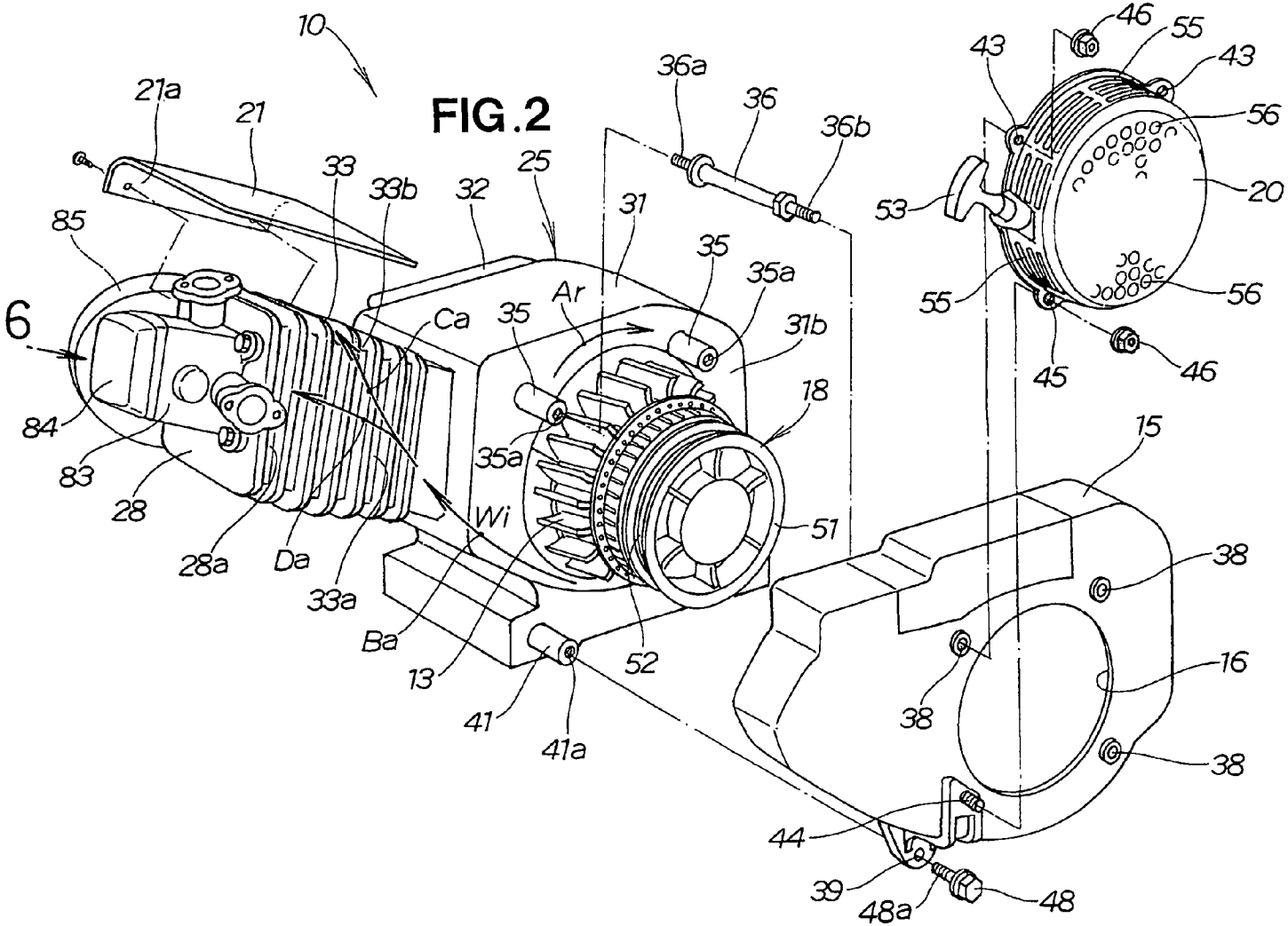
FIG. 2 is an exploded perspective view of the air-cooled engine shown in FIG. 1.

As shown in FIGS. 1 and 2, the air-cooled engine 10 is an OHC (overhead-cam) single-cylinder engine having a tilted cylinder. The engine and comprises a cooling fan 13, a fan cover 15 that covers the cooling fan 13, a recoil starter 18, a starter cover 20 that covers the recoil starter 18, a fuel tank 22, an air cleaner 23, and a muffler 24.

Figure 3:
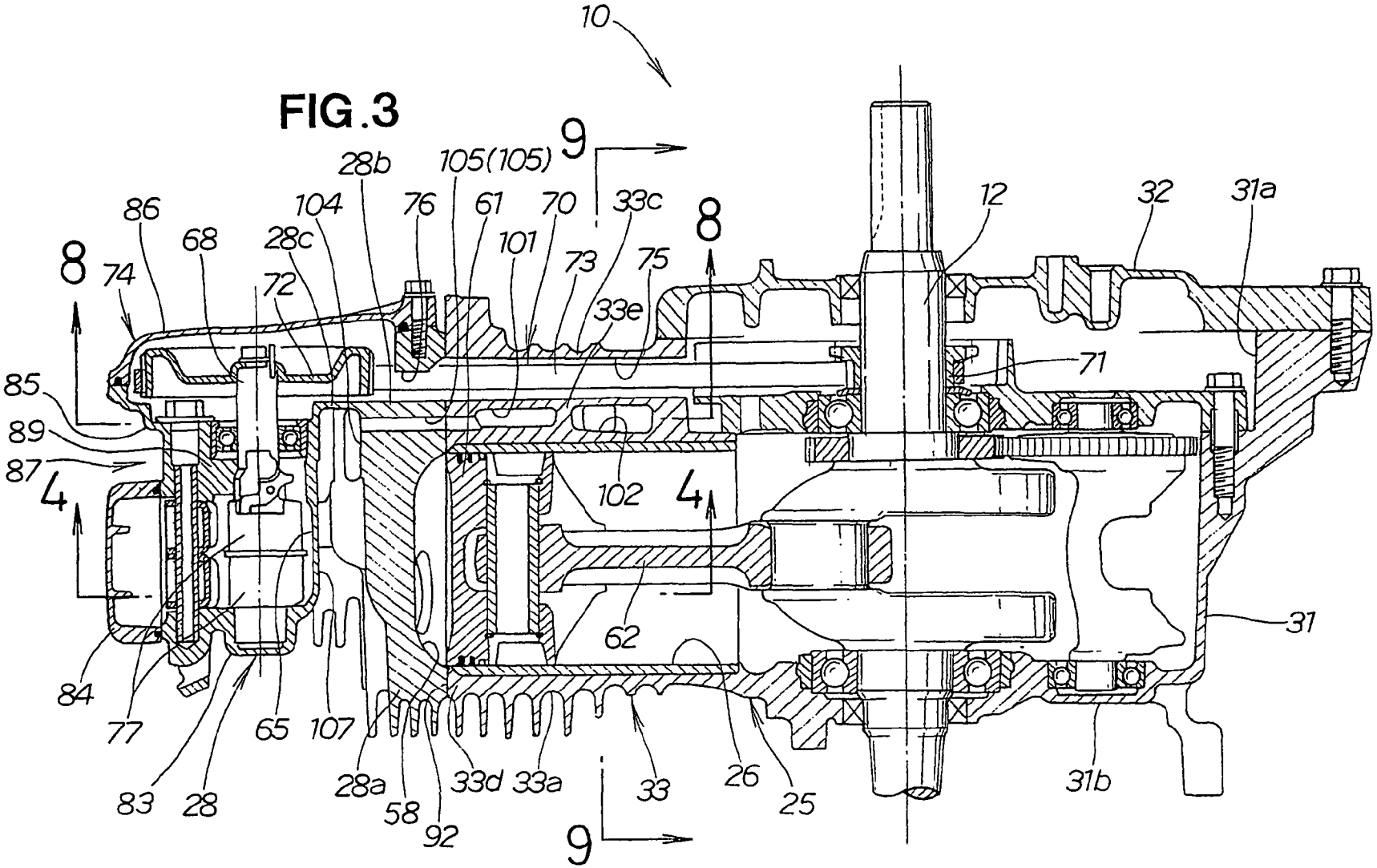
FIG. 3 is a cross-sectional view of the air-cooled engine shown in FIG. 1.

As shown in FIG. 2, the cooling fan 13 and the recoil starter 18 are linked with a crankshaft 12 (see FIG. 3). The fan cover 15 has an opening 16 through which the recoil starter 18 passes.

As shown in FIGS. 2 and 3, the air-cooled engine 10 includes the crankshaft 12, a casing 25, a cylinder 26, and a cylinder head 28.

The casing 25 is composed of a crank case 31, a case cover 32 that closes off the opening 31*a* of the crank case 31, and a cylinder block 33 formed integrally on the side of the crank case 31 (the left end in FIG. 2).

The crank case 31 rotatably accommodates the crankshaft 12. The opening 31*a* of the crank case 31 can be covered with the case cover 32 by bolting the case cover 32 onto the crank case 31. The cylinder block 33 and the cylinder 26 (see FIG. 3) housed within the cylinder block 33 are tilted upward from the side portion of the crank case 31, as shown in FIG. 2.

The crank case 31 comprises three bosses 35 (only two are shown) on one side 31*b*, and one boss 41 disposed at a position separate from the three bosses 35, as shown in FIG. 2. The three bosses 35 have the threaded parts 36*a* of stud bolts 36 screwed into screw holes 35*a*. The three stud bolts 36 are thus mounted on one side 31*b* of the crank case 31. The stud bolts 36 also have threaded parts 36*b* at their distal ends.

The procedure of attaching the fan cover 15 and the starter cover 20 is as follows.

First, the three threaded parts 36*b* are inserted into three mounting holes 38 in the fan cover 15. At the same time, the position of a mounting hole 39 in the fan cover 15 is matched with a screw hole 41*a* in the boss 41.

Next, the three threaded parts 36*b* are inserted through three mounting holes 43 (only two are shown) in the starter cover 20. At the same time, a bolt 44 in the fan cover 15 is inserted into a mounting hole 45 in the starter cover 20.

Next, nuts 46 are screwed over the three threaded parts 36*b* and the bolt 44.

Furthermore, a bolt 48 is inserted through the mounting hole 39 in the fan cover 15, and a threaded part 48*a* is screwed into the screw hole 41*a* in the boss 41.

The fan cover 15 can thus be attached to one side 31*b* of the crank case 31, and the starter cover 20 can be attached to the fan cover 15.

As shown in FIG. 2, the recoil starter 18 includes a pulley 51 linked with the crankshaft 12 (see FIG. 3), and a starter rope 52 that is wound around the pulley 51. The starter rope 52 has a grip 53 at the distal end. FIG. 2 shows the grip 53 as being detached from the starter rope 52 and positioned on the side of the starter cover 20, for the sake of simplicity.

As shown in FIG. 2, the air-cooled engine 10 comprises a guide cover 21 that covers the tops of both the cylinder head 28 and the cylinder block 33. The guide cover 21 performs the function of guiding cooling air Wi from the cooling fan 13 along the top portion 33*b* of the cylinder block 33. The cover is bolted onto the cylinder head 28 and the cylinder block 33.

Next, the cross-sectional structure of the air-cooled engine 10 will be described.

As shown in FIG. 3, a piston 61 is reciprocatingly accommodated within the cylinder 26 and is linked with the crankshaft 12 via a connecting rod 62.

Figure 4:
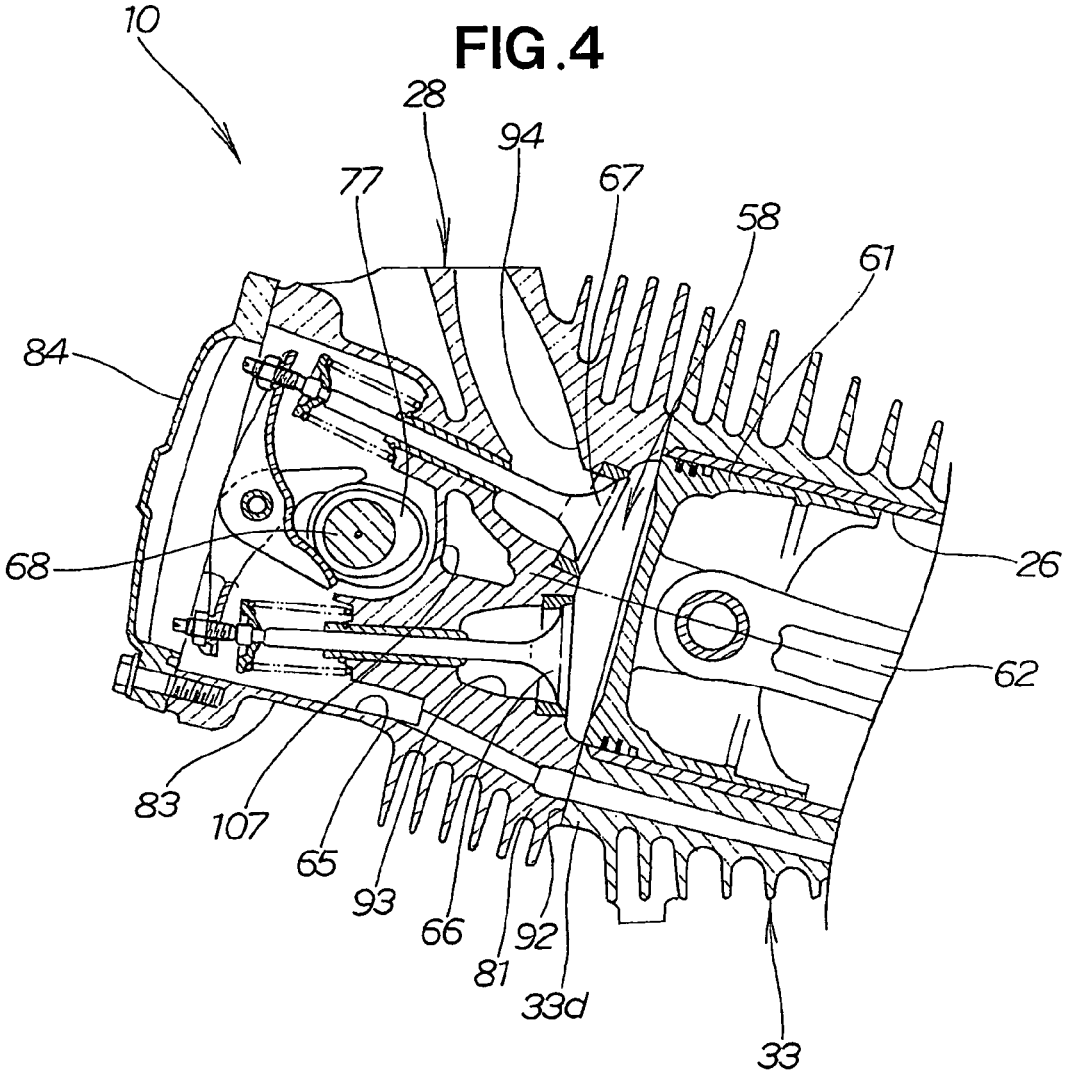
FIG. 4 is a cross-sectional view along the line 4-4 in FIG. 3.

As shown in FIGS. 3 and 4, the cylinder head 28 is superposed on and bolted to the distal end surface of the cylinder block 33, i.e., the head 33*d*. The cylinder head 28 is a member that closes off one end of the cylinder 26. A combustion chamber 58 is formed in the area that faces the head 33*d*, and a valve chamber 65 is formed adjacent to the combustion chamber 58 on the side opposite from the combustion chamber 58. The valve chamber 65 accommodates an intake valve 66, an exhaust valve 67, and a camshaft 68.

The camshaft 68 is linked with the crankshaft 12 via a power transmission mechanism 70. The power transmission mechanism 70 transmits drive force from the crankshaft 12 to the camshaft 68, and is disposed along the cylinder 26 and the combustion chamber 58. The power transmission mechanism 70 is composed of a drive pulley 71 mounted on the crankshaft 12, a driven pulley 72 mounted on the camshaft 68, and a belt 73 wound over the drive pulley 71 and the driven pulley 72.

The rotation of the crankshaft 12 brings about rotation of the drive pulley 71, the belt 73, the driven pulley 72, the camshaft 68, and a pair of cams 77, 77. As a result, the intake valve 66 and the exhaust valve 67 operate to open and close an intake port and an exhaust port that face the combustion chamber 58. The intake valve 66 and the exhaust valve 67 can be opened and closed in synchronization with the rotation timing of the crankshaft 12.

As shown in FIG. 3, the power transmission mechanism 70 is accommodated in a transmission mechanism compartment 74. The transmission mechanism compartment 74 is composed of belt insertion slots 75, 76, a pulley compartment 85, and a pulley cover 86. The belt insertion slot 75 is formed on the other lateral portion 33*c* of the cylinder block 33. The belt insertion slot 76 is formed on the other side 28*b* of the cylinder head 28. The belt 73 is passed through the belt insertion slots 75, 76.

Figure 5:
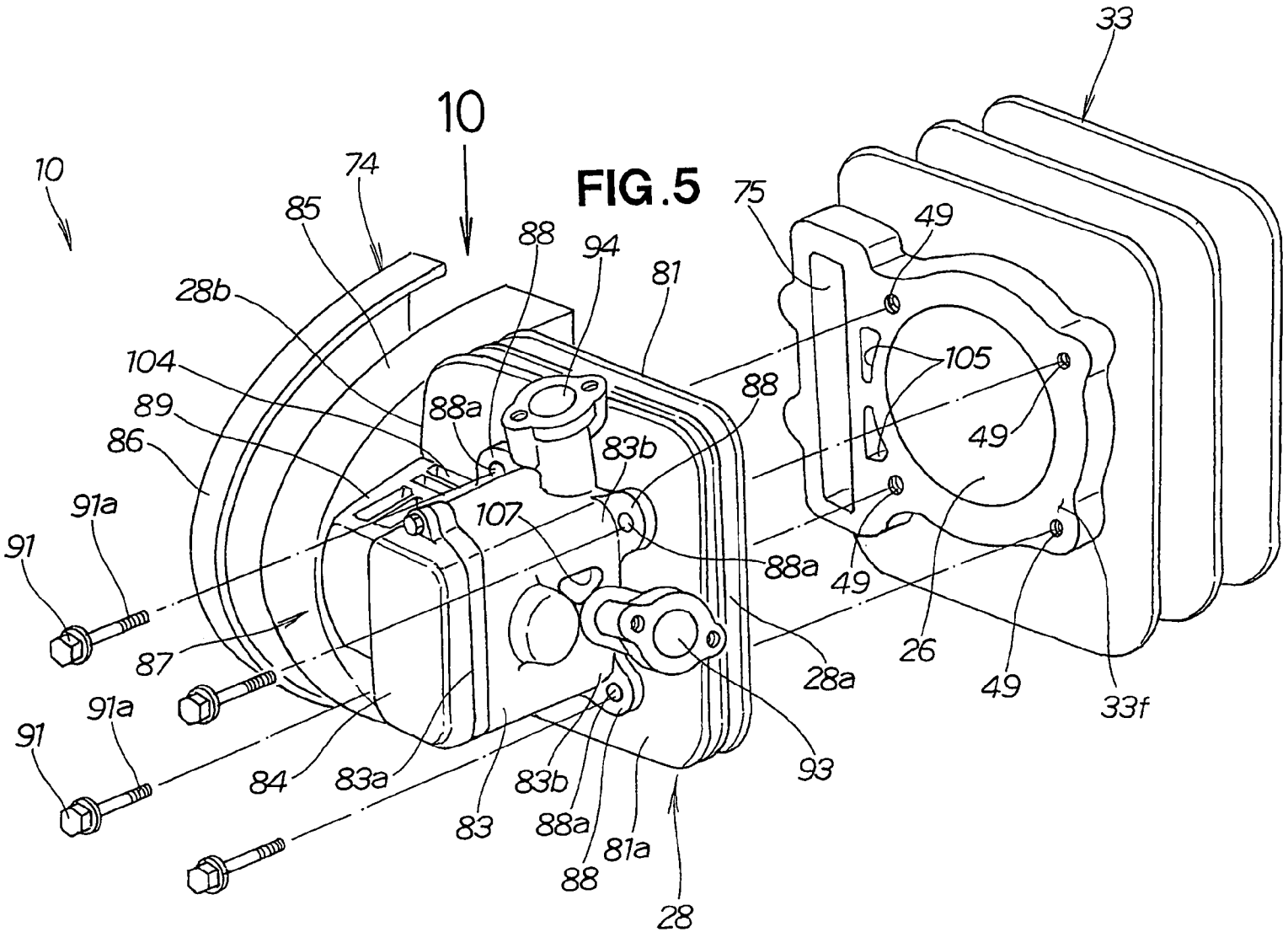
FIG. 5 is an exploded perspective view of the area surrounding the cylinder head in the air-cooled engine shown in FIG. 2.
Figure 6:
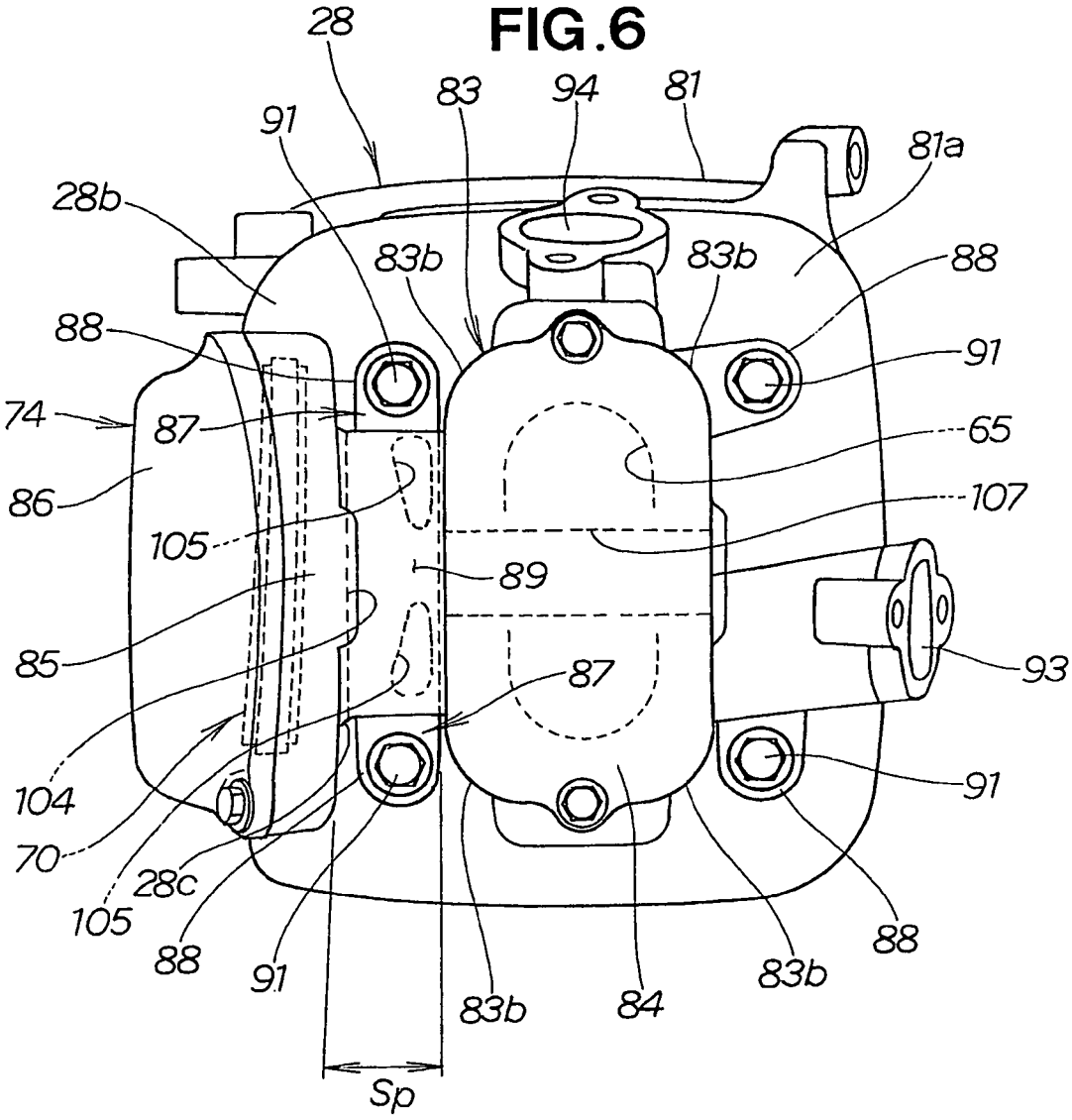
FIG. 6 is a view along the arrow line 6 in FIG. 2.

As shown in FIGS. 5 and 6, the cylinder head 28 is an integrally molded article composed of a base part 81, a valve compartment 83, the pulley compartment 85, and a coupler 89.

The base part 81 is a flat discoid member that is superposed on the end surface 33*f* (flange surface 33*f*) of the cylinder block 33, and has an intake port 93 and an exhaust port 94 (see also FIG. 4).

The valve compartment 83 is located on the surface 81*a* of the base part 81 on the side opposite from the cylinder block 33. The distal open surface 83*a* (flange surface 83*a*) of the valve compartment 83 is closed off by a head cover 84. The head cover 84 is bolted onto the valve compartment 83. The outer shape of the valve compartment 83 is substantially rectangular when the valve compartment 83 is viewed from the side of the head cover 84.

The valve chamber 65 (see FIG. 4) constitutes an internal space in the valve compartment 83 that is closed off by the head cover 84. As described above, the intake valve 66, the exhaust valve 67, and the camshaft 68 can be accommodated in the valve chamber 65 inside the valve compartment 83. It is apparent that the valve compartment 83 has the internally disposed valve chamber 65 and is therefore one size larger than the outer shape of the valve chamber 65.

The pulley compartment 85 is a member for accommodating the driven pulley 72 (see FIG. 3), and the open end thereof is closed off by the pulley cover 86. More specifically, the pulley compartment 85 is placed at a specific distance Sp from the valve compartment 83 (i.e., the valve chamber 65) towards the other side 28*b* of the cylinder head 28, as shown in FIG. 6.

Thus, at least part of the transmission mechanism compartment 74, i.e., the pulley compartment 85 is formed in the cylinder head 28 at a specific gap 87 from the valve compartment 83. As a result, a space 87 (gap 87) having a specified dimension Sp can be maintained between the valve compartment 83 and the pulley compartment 85, as shown in FIGS. 3, 5, and 6. The provision of this space 87 allows the valve compartment 83 and the pulley compartment 85 to be integrally formed by means of the coupler 89 through which the camshaft 68 passes.

The coupler 89 has a head-cooling duct 104 formed between the valve compartment 83 and the pulley compartment 85. The head-cooling duct 104 serves as a duct through which cooling air flows.

As shown in FIGS. 5 and 6, the base part 81 has a plurality of bosses 88 on the surface 81*a* on the side opposite from the cylinder block 33. This plurality (four, for example) of bosses 88 are disposed at the four corners 83*b* surrounding the valve compartment 83. The bosses 88 have a plurality of mounting holes 88*a* whereby the base part 81 is mounted. The positions of the mounting holes 88*a* coincide with the positions of the screw holes 49 formed on the flange surface 33*f* of the cylinder block 33.

The procedure for fastening the cylinder head 28 to the cylinder block 33 is as follows.

First, as shown in FIGS. 4 and 5, a gasket 92 (seal member 92) is set into the flange surface 33*f* of the cylinder block 33, and the base part 81 is superposed thereon.

Next, a plurality of head bolts 91 (hereinbelow referred to simply as "bolts 91") are inserted into the mounting holes 88*a* from the end surface 81*a* of the base part 81, and threaded portions 91*a* are allowed to protrude out and are screwed into the screw holes 49, completing the operation.

As described above, the four mounting holes 88*a* and the four bolts 91 are all disposed closer to the four outer corners 83*b* away from the valve compartment 83, i.e., in the areas outside of the valve chamber 65. Therefore, the lubricating oil in the valve chamber 65 does not pass through the mounting holes 88*a* and does not leak (seep out, for example) between the cylinder head 28 and the cylinder block 33.

Therefore, there is no need to adopt oil-sealing measures, such as placing a gasket 92 with a complicated shape between the cylinder head 28 and the cylinder block 33, in order to prevent oil from leaking from the valve chamber 65. The air-cooled engine 10 can therefore have a simpler structure.

Furthermore, since all of the bolts 91 are disposed at the four corners 83*b* outside of the valve compartment 83, the service conditions (temperature and the like) of the bolts 91 can be kept substantially identical. The thermal strain in the bolts 91 can be made uniform, and uniform and favorable thermal strain can therefore be preserved in the cylinder 26 and the combustion chamber 58 (see FIG. 4). Moreover, the durability of the bolts 91 can be sufficiently improved because the thermal strain in the bolts 91 is uniform.

There is also no need to dispose the bolts 91 inside the valve chamber 65, because all the bolts 91 are disposed in areas outside of the valve compartment 83. The size of the air-cooled engine 10 can be reduced by reducing the size of the valve compartment 83 in proportion to the absence of the space for accommodating the bolts 91 in the valve chamber 65.

Furthermore, since the valve compartment 83 is smaller, it is possible to increase the surface area of the portion of the cylinder head 28 exposed in the vicinity of the combustion chamber 58, i.e., the radiating surface area. Moreover, the distance from the outer surface of the valve compartment 83 to the combustion chamber 58 can be reduced because the valve compartment 83 is smaller. Therefore, cooling air can be conducted to the vicinity of the combustion chamber 58. As a result, the area surrounding the combustion chamber 58 in the cylinder head 28 can be cooled more adequately, and cooling efficiency can be improved.

Furthermore, the two left-hand side bolts 91, 91 (some of the bolts) out of the four bolts 91 are disposed between the valve compartment 83 and the transmission mechanism compartment 74. Therefore, the two left-hand side head bolts 91, 91 can be disposed in the vicinity of the valve compartment 83 in the same manner as the other two head bolts 91, 91. As a result, the service temperature of all the bolts 91 can be made even more uniform. The thermal strain in all the bolts 91 can thereby be made more uniform.

Next, the cooling ducts of the air-cooled engine 10 will be described.

As shown in FIG. 3, the cylinder block 33 has two cylinder-cooling ducts 101, 102, i.e., a first cylinder-cooling duct 101 and a second cylinder-cooling duct 102, for conducting cooling air to the area 33*e* between the cylinder 26 and the belt insertion slot 75.

As shown in FIGS. 3 and 7 through 9, the first cylinder-cooling duct 101 is aligned vertically in a direction that intersects the axial line 109 (see FIG. 7) of the cylinder 26. The first cylinder-cooling duct 101 has a top inlet 101*a* that opens into the top of the cylinder block 33, and a bottom outlet 101*b* that opens into the bottom of the cylinder block 33.

The second cylinder-cooling duct 102 is substantially parallel to the first cylinder-cooling duct 101, is disposed farther away from the cylinder head 28 than the first cylinder-cooling duct 101, and is aligned vertically. The second cylinder-cooling duct 102 has a top inlet 102*a* that opens into the top of the cylinder block 33, and a bottom outlet 102*b* that opens into the bottom of the cylinder block 33.

The cylinder head 28 has two cooling ducts 104, 107, i.e., a head-cooling duct 104 and a guide-cooling duct 107, for conducting cooling air in the manner shown in FIGS. 3, 7, 8, and 10.

The head-cooling duct 104 is formed vertically in the area 28*c* between the valve chamber 65 and the belt insertion slot 76, and is substantially parallel to the first and second cylinder-cooling ducts 101, 102. The head-cooling duct 104 has a top inlet 104*a* that opens into the top of the cylinder head 28, and a bottom outlet 104*b* that opens into the bottom of the cylinder head 28.

Figure 7:
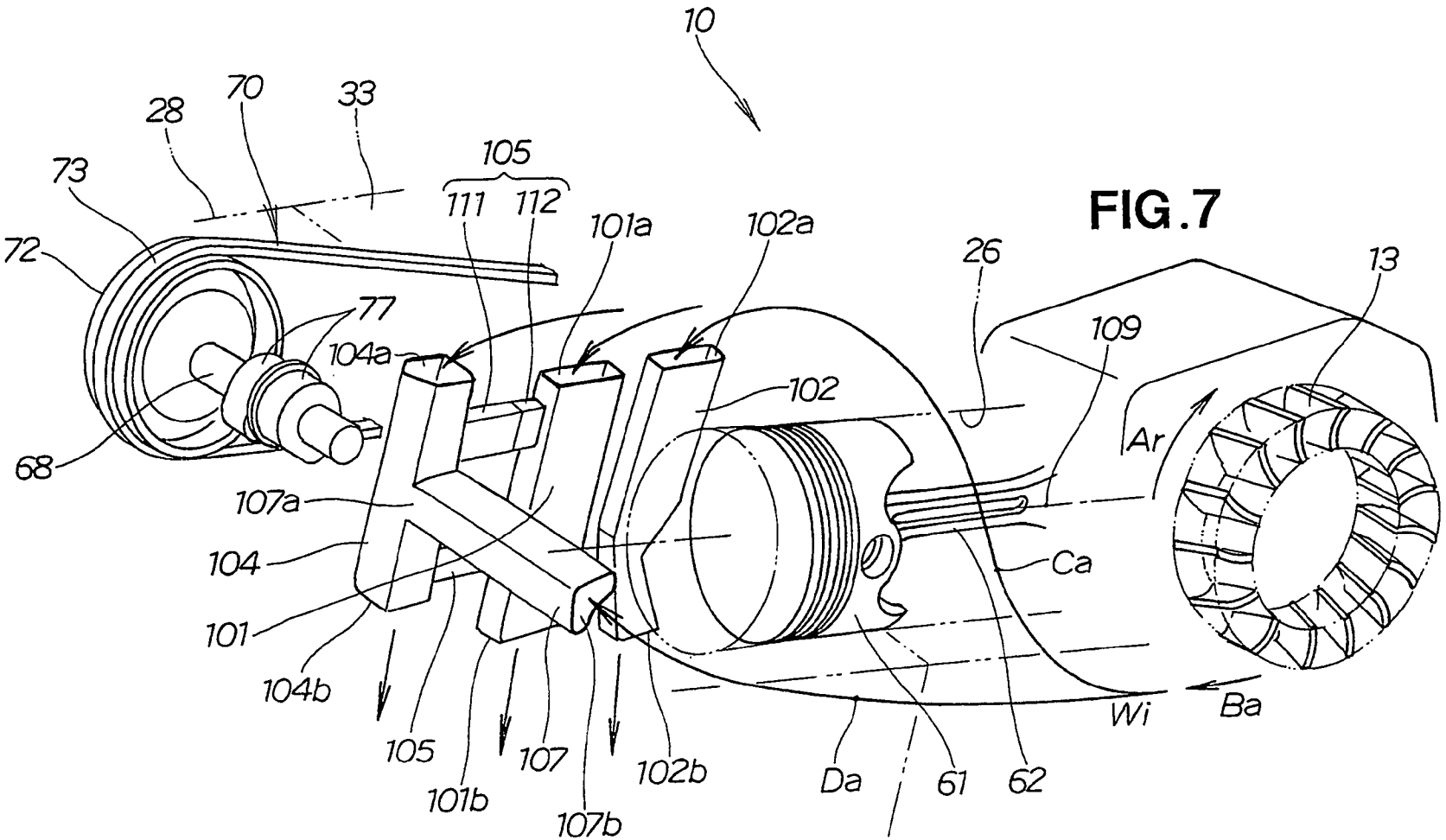
FIG. 7 is a diagram for describing the cooling ducts in the air-cooled engine shown in FIG. 2.
Figure 8:
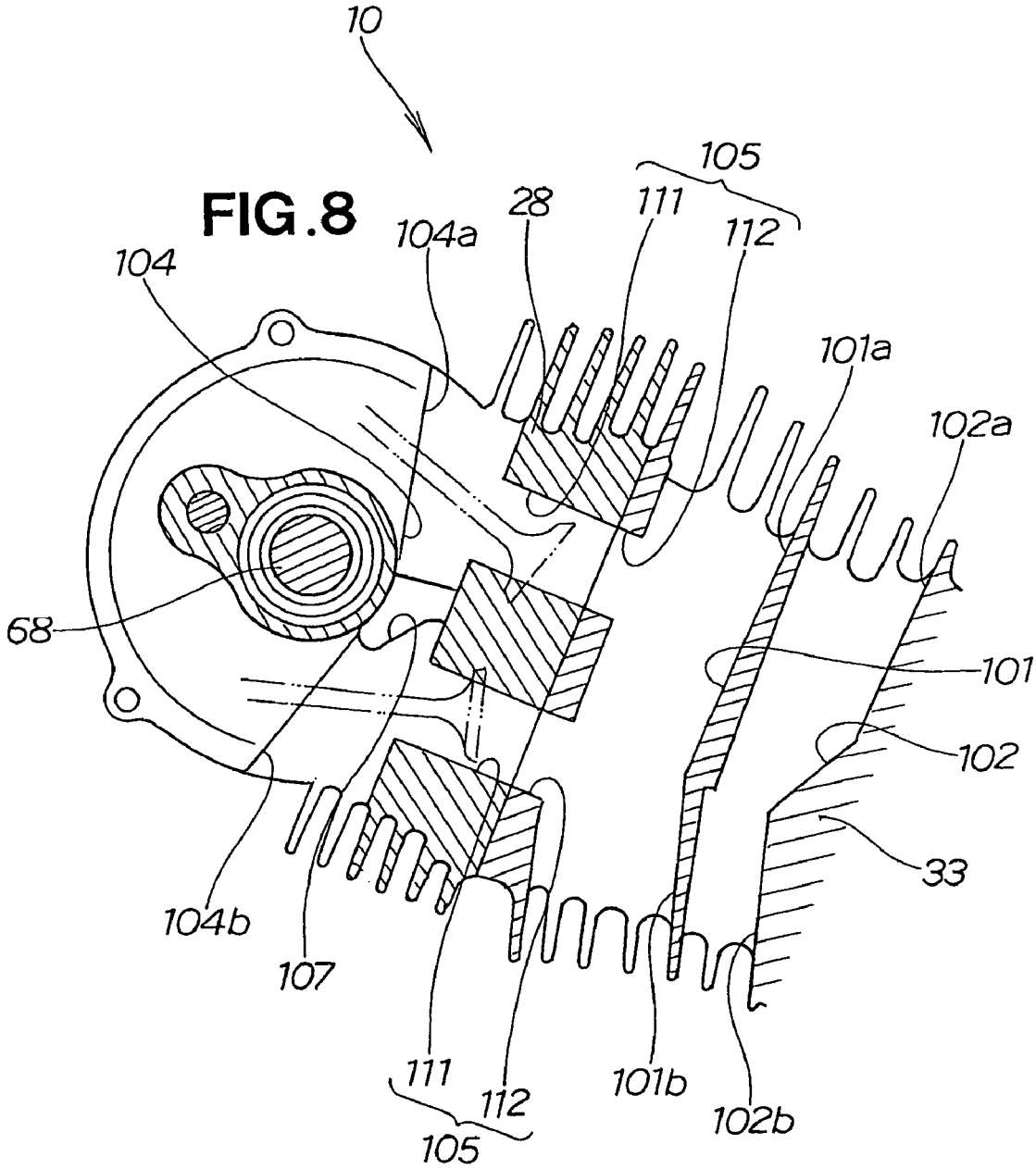
FIG. 8 is a cross-sectional view along the line 8-8 in FIG. 3.

As shown in FIGS. 7 and 8, the head-cooling duct 104 is communicated with the first cylinder-cooling duct 101 by means of a pair of communicating channels 105, 105. The pair of communicating channels 105, 105 are formed at a fixed distance from each other. The communicating channels 105 are composed of a head-side communicating channel 111 formed in the cylinder head 28, and a cylinder-side communicating channel 112 formed in the cylinder block 33.

As shown in FIGS. 3, 7, and 8, the guide-cooling duct 107 is formed in a direction substantially orthogonal to the head-cooling duct 104. This guide-cooling duct 107 has an outlet 107*a* that is communicated with the substantial center of the head-cooling duct 104, and an inlet 107*b* that opens into the lateral portion 28*a* (see FIG. 3) opposite from the pulley compartment 85, i.e., in the first lateral portion 28*a*. Providing the inlet 107*b* to the lateral portion 28*a* opposite from the pulley compartment 85 makes it easier to make the inlet 107*b* face the exterior. Therefore, there is a high degree of freedom in designing the engine, and productivity can be improved because it is possible to easily set the shape of the guide-cooling duct 107 and the arrangement of the guide-cooling duct 107 in relation to the cylinder head 28. Moreover, cooling air can easily be admitted into the guide-cooling duct 107 from the inlet 107*b*.

Next, the manner in which cooling air flows from the cooling fan 13 will be described.

As shown in FIG. 2, the cooling fan 13 is rotated in the direction of the arrow Ar by the crankshaft 12 (see FIG. 3). The rotating cooling fan 13 expels outside air that has been drawn in from the outside air inlets 55, 56 towards the first lateral portion 33*a* of the cylinder block 33 (in the direction of the arrow Ba). The expelled outside air constitutes cooling air Wi for cooling the air-cooled engine 10.

Part of the cooling air Wi flows upward, as shown by the arrow Ca, from the first lateral portion 33*a* of the cylinder block 33, and is conducted along the top portion 33*b* of the cylinder block 33 by the guide cover 21. The cooling air Wi conducted along the top portion 33*b* is directed downward by a curved part 21*a* of the guide cover 21. The cooling air Wi that has been directed downward is conducted down along the other lateral portion 33*c* of the cylinder block 33 shown in FIG. 3.

In FIG. 2, the remaining part Wi of the cooling air Wi, moving as shown by the arrow Ba, is conducted as shown by the arrow Da along one lateral portion 28*a* of the cylinder head 28.

The cooling air Wi flowing upward as shown by the arrow Ca is admitted into the top inlets 101*a*, 102*a*, 104*a*, as shown in FIGS. 11A, 11B, 12A, and 12B. The cooling air Wi flowing to the side as shown by the arrow Da is admitted into the inlet 107*b*.

The cooling air Wi admitted into the top inlet 101*a* flows through the first cylinder-cooling duct 101 and then flows out from the bottom outlet 101*b*, as shown by the arrow Ea. The cooling air Wi admitted into the top inlet 102*a* flows through the second cylinder-cooling duct 102 and then flows out from the bottom outlet 102*b*, as shown by the arrow Fa.

Figure 9:
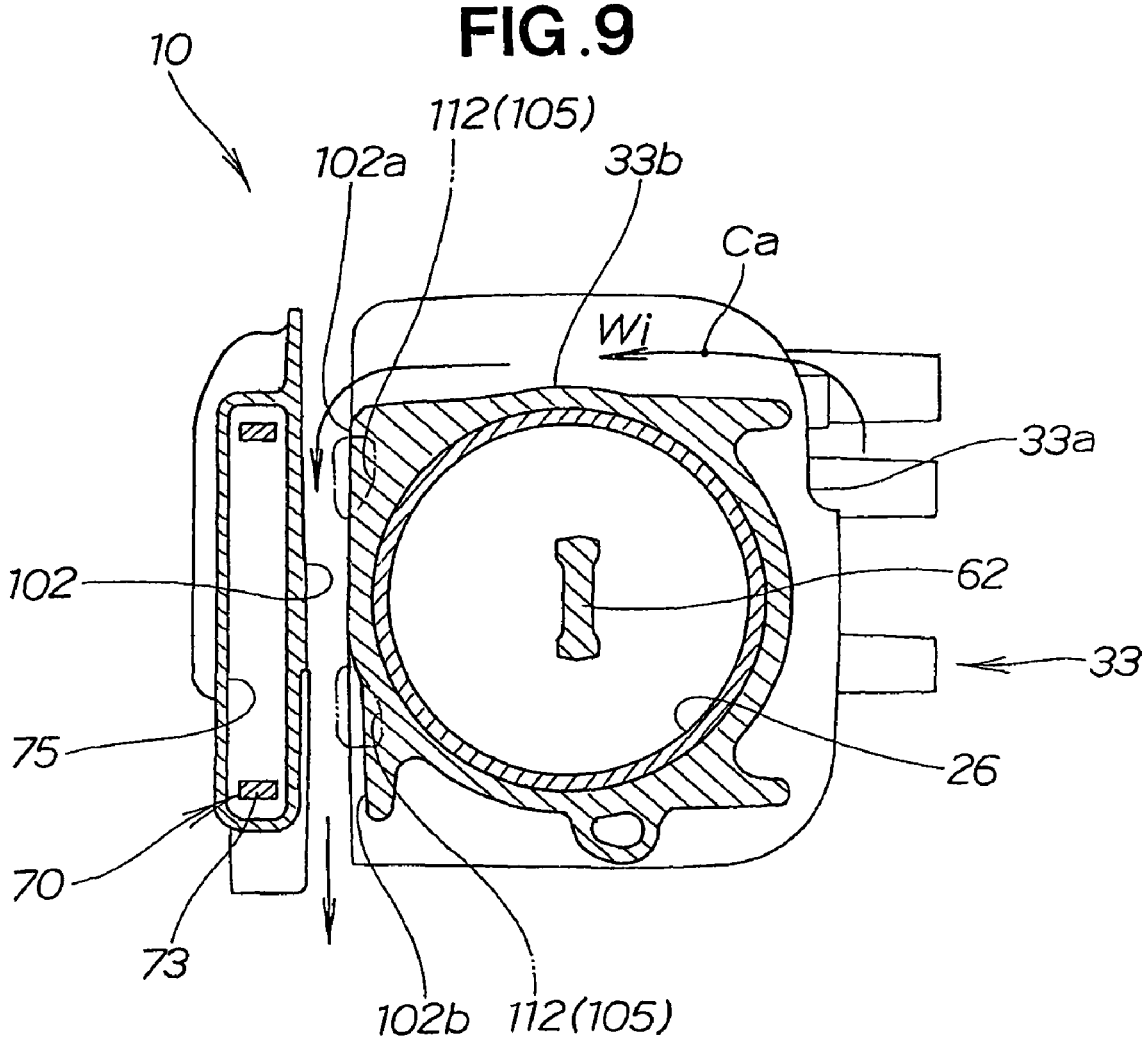
FIG. 9 is a cross-sectional view along the line 9-9 in FIG. 3.
Figure 10:
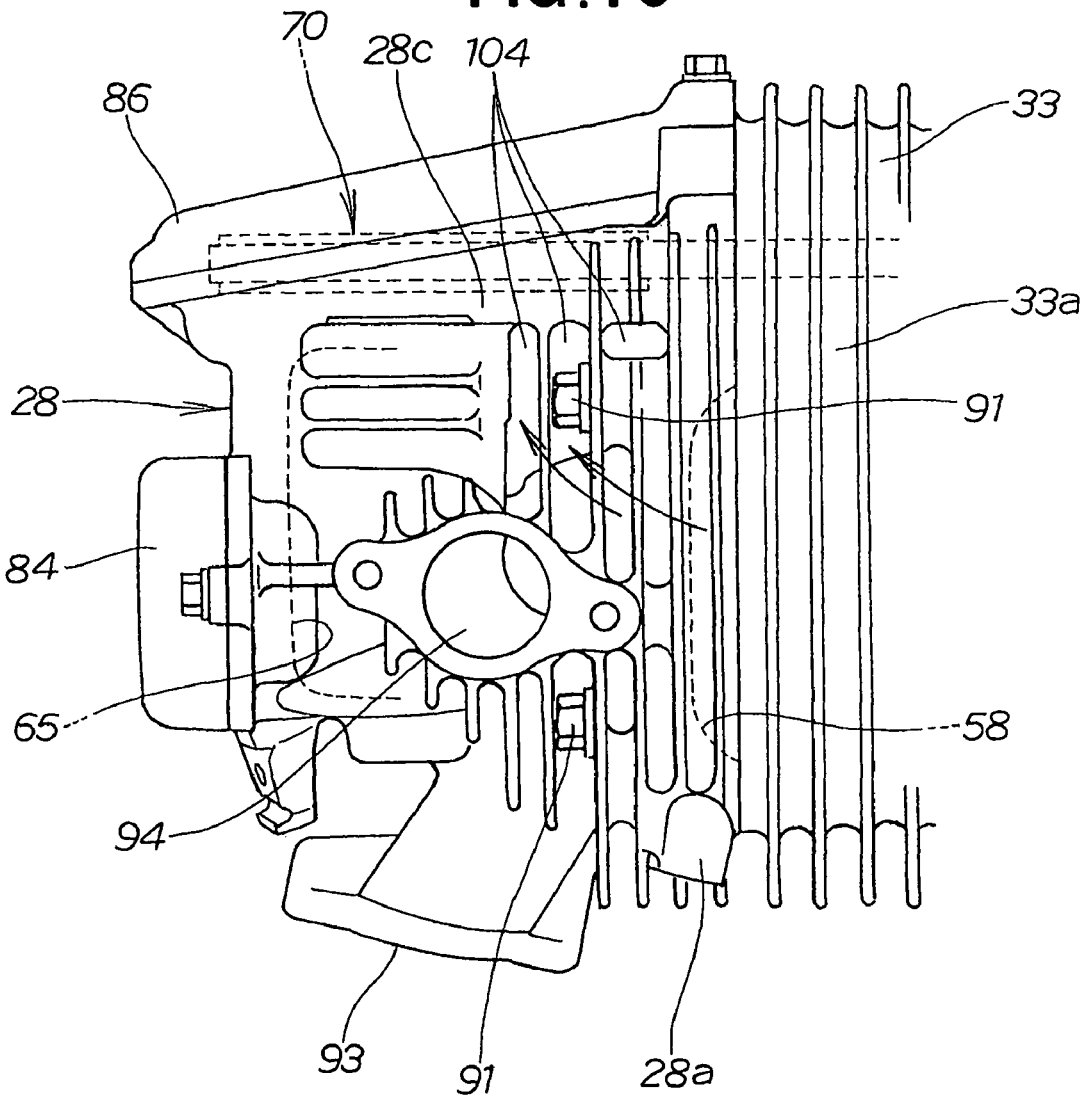
FIG. 10 is a view along the arrow 10 in FIG. 5.

Specifically, the cooling air Wi flows from the first lateral portion 33*a* to the top portion 33*b* of the cylinder block 33, as shown by the arrow Ca in FIG. 9. The cooling air Wi that has flowed over the top portion 33*b* is admitted into the top inlet 102*a* and is caused to flow through the first cylinder-cooling duct 102 and then out from the bottom outlet 102*b*. The same is true for the cooling air Wi that flows through the first cylinder-cooling duct 101 (see FIGS. 12A and 12B).

Thus, a large amount of cooling air Wi can be made to flow to the vicinity of the cylinder 26 because the cooling air Wi flows through two cooling ducts, which are the first and second cylinder-cooling ducts 101, 102. As a result, the area surrounding the cylinder 26 can be cooled efficiently by the cooling air Wi.

Figure 12A:
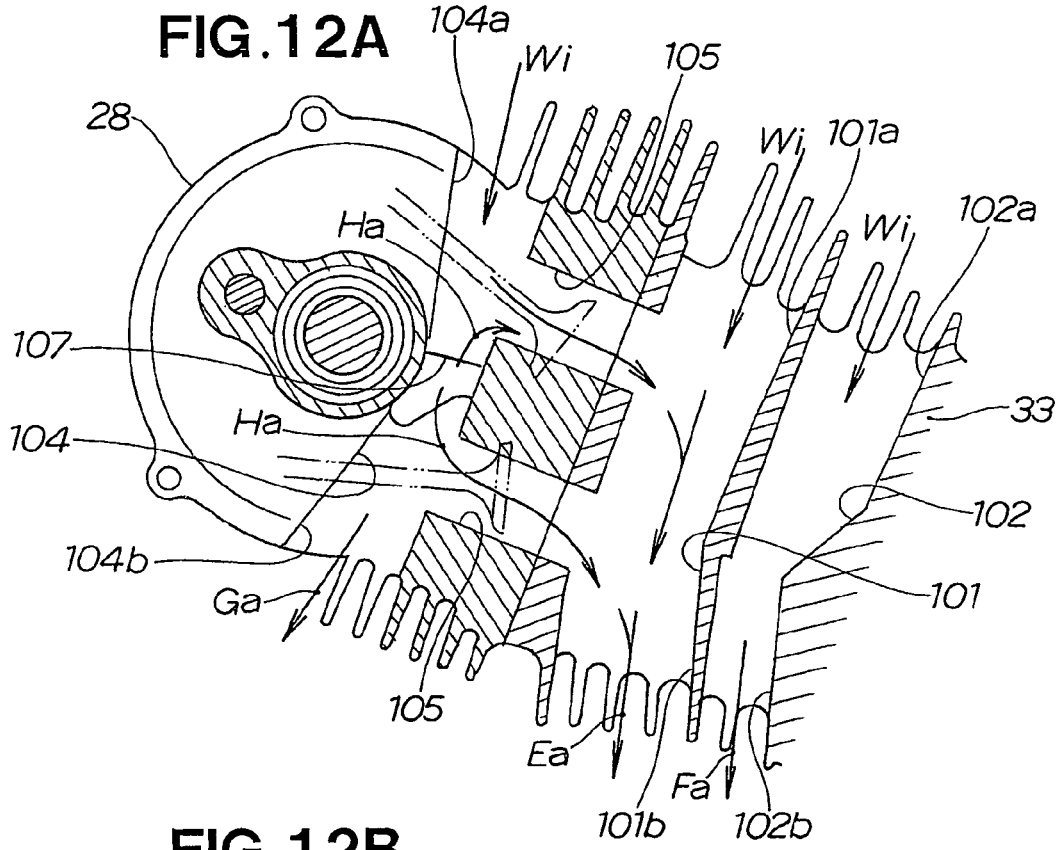
FIGS. 12A and 12B are diagrams for describing the manner in which cooling air flows through the cooling ducts shown in FIGS. 3 and 8.

As shown in FIG. 12A, the cooling air Wi admitted into the top inlet 104*a* flows through the head-cooling duct 104 and then out from the bottom outlet 104*b*, as shown by the arrow Ga. Admitting the cooling air Wi into the head-cooling duct 104 allows the cooling effects of the cylinder head 28 to be further improved. More specifically, the cooling air flows from the first lateral portion 28*a* of the cylinder head 28, as shown by the arrow in FIG. 10. The cooling air that has flowed over the first lateral portion 28*a* is conducted through the top inlet 104*a* and is caused to flow through the head-cooling duct 104.

Figure 11A:
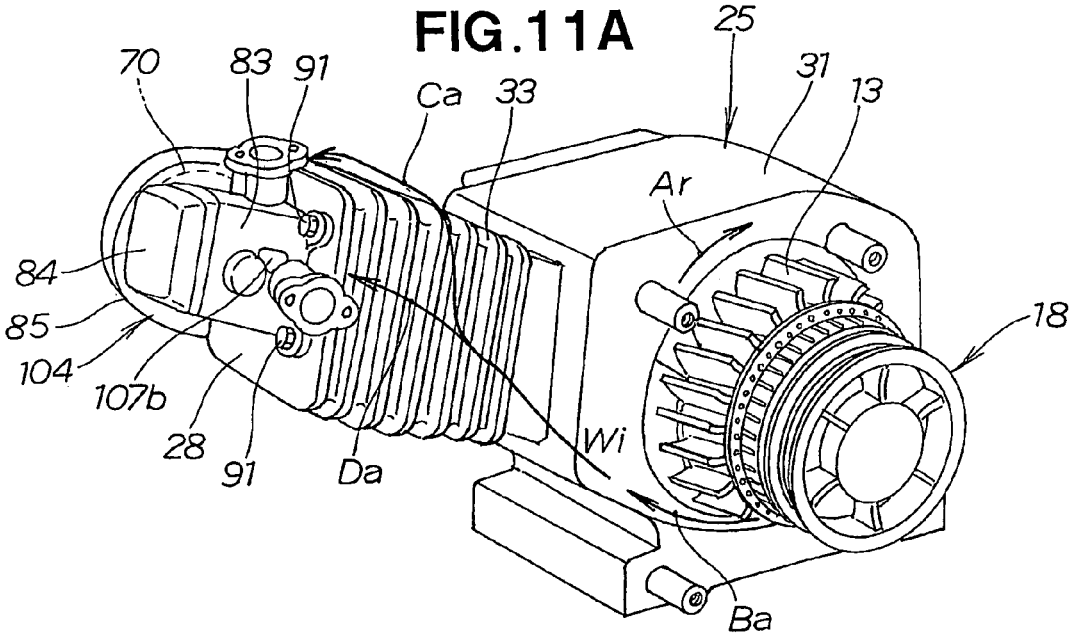
FIGS. 11A and 11B are diagrams for describing the manner in which cooling air is conducted through the cooling ducts in the air-cooled engine shown in FIG. 2.
Figure 11B:
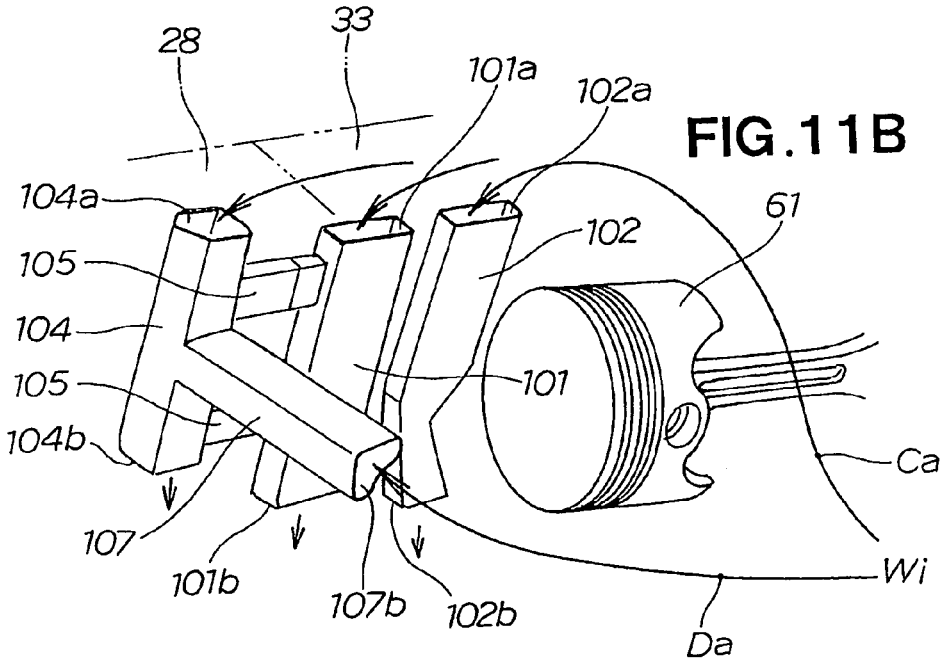
Figure 12B:
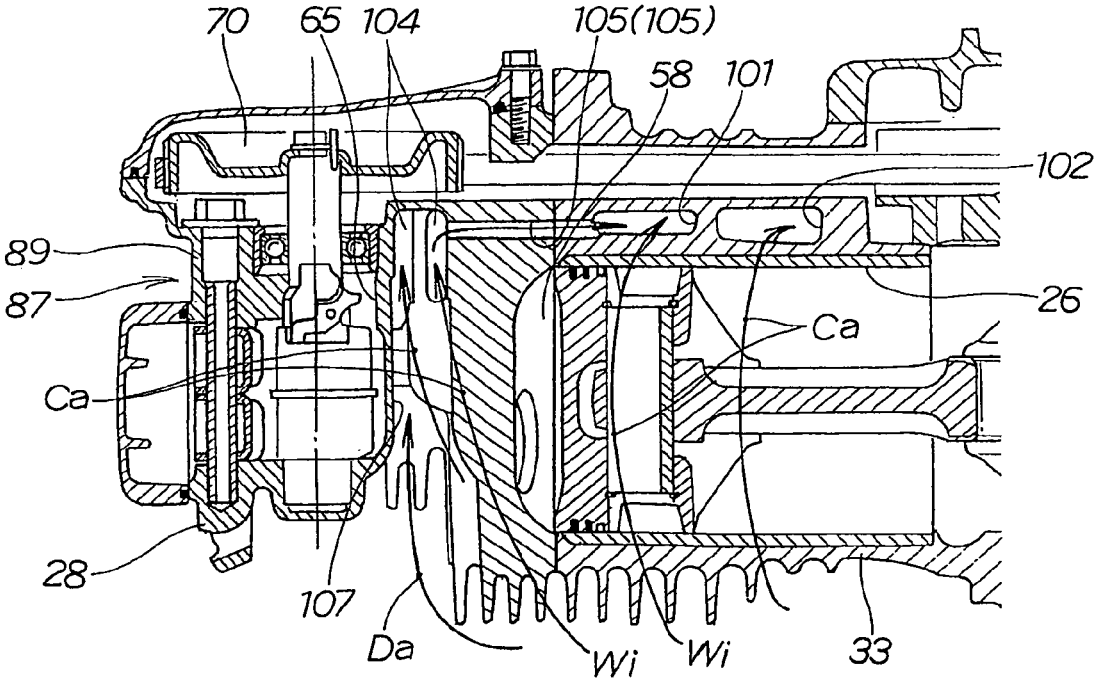

As shown in FIGS. 11B, 12A, and 12B, the cooling air Wi admitted into the inlet 107*b* flows into the guide-cooling duct 107, enters the head-cooling duct 104, and mixes with the cooling air Wi from the top inlet 104*a*. Accordingly, a large amount of air can be made to flow through the head-cooling duct 104. Part of the cooling air Wi that flows through the head-cooling duct 104 passes through a pair of communicating channels 105, 105 and flows into the first cylinder-cooling duct 101, as shown by the arrow Ha.

Since the head-cooling duct 104 and the first cylinder-cooling duct 101 are thus linked by a pair of communicating channels 105, 105, the cooling air Wi that has flowed over the cylinder head 28 can be satisfactorily conducted to the cylinder block 33. The cooling air Wi needed to cool the cylinder 26 can thereby be satisfactorily conducted to the cylinder 26. Cooling air Wi can be allowed to flow in the vicinity of the combustion chamber 58 to efficiently cool both the cylinder head 28 and the cylinder block 33. This is achieved by conducting cooling air Wi to the head-cooling duct 104 and the first cylinder-cooling duct 101.

In the present invention, four head bolts were used as examples of the head bolts 91, but only a suitable number of bolts need be used to mount the base part 81 on the cylinder block 33.

Also, sealing the surface where the cylinder head 28 and the cylinder block 33 meet with the gasket 92 is arbitrary. Whether or not to use the gasket 92 should be decided with consideration given to the seal or the component for the combustion chamber 58. A gasket for preventing oil from leaking from the valve chamber 65 is unnecessary.

INDUSTRIAL APPLICABILITY

The present invention can be appropriately applied to an air-cooled engine in which a cylinder head is fastened to a cylinder block with a plurality of head bolts.

The invention claimed is:

1. An air-cooled engine that is cooled using cooling air, said engine comprising:

a cylinder block provided with a cylinder having a reciprocating piston;

a crank case accommodating and supporting a crankshaft linked with the piston;

a cylinder head closing off one end of the cylinder, said cylinder head including a base part that is superposed on and secured to the cylinder block by a plurality of bolts, wherein a valve compartment is formed integrally on the base part and accommodates an intake valve, an exhaust valve, and a camshaft for operating the intake valve and exhaust valve, and all of the bolts are disposed near the outer periphery of the base part at positions outside of the valve compartment;

a power transmission mechanism transmitting drive force from the crankshaft to the camshaft; and a transmission mechanism compartment accommodating the power transmission mechanism and at least part of the transmission mechanism compartment being formed in the cylinder head so as to be separated from the valve compartment, wherein the valve compartment and the transmission mechanism compartment are formed integrally by a coupler through which the camshaft passes, and wherein the coupler has a head-cooling duct formed therethrough to allow the cooling air to flow through.

2. The air-cooled engine of claim 1, wherein the cylinder block has cylinder-cooling ducts formed therethrough around the cylinder to allow the cooling air to flow through; and the cylinder-cooling duct is linked with the head-cooling duct.

3. An air-cooled engine that is cooled using cooling air, said engine comprising:

a cylinder block provided with a cylinder having a reciprocating piston;

a crank case accommodating and supporting a crankshaft linked with the piston;

a cylinder head closing off one end of the cylinder, said cylinder head including a base part that is superposed on and secured to the cylinder block by a plurality of bolts, wherein a valve compartment is formed integrally on the base part and accommodates an intake valve, an exhaust valve, and a camshaft for operating the intake valve and exhaust valve, and all of the bolts are disposed near the outer periphery of the base part at positions outside of the valve compartment;

a power transmission mechanism transmitting drive force from the crankshaft to the camshaft; and a transmission mechanism compartment accommodating the power transmission mechanism and at least part of the transmission mechanism compartment being formed in the cylinder head so as to be separated from the valve compartment, wherein some of the bolts are positioned between the valve compartment and the transmission mechanism compartment.

* * * * *